United States Patent [19]

Lohmann

[11] 4,218,928

[45] Aug. 26, 1980

[54] DOUBLE ACTING DELAY MECHANISM

[75] Inventor: Arthur M. Lohmann, Hopkins, Minn.

[73] Assignee: The United States of America as represented by the Secretary of the Air Force, Washington, D.C.

[21] Appl. No.: 1,329

[22] Filed: Jan. 5, 1979

[51] Int. Cl.[3] ..... G05G 17/00

[52] U.S. Cl. ..... 74/3.52

[58] Field of Search ..... 74/3.52; 102/256

[56] References Cited

U.S. PATENT DOCUMENTS

| | | | |
|---|---|---|---|
| 1,942,599 | 1/1934 | Hirsch | 74/3.52 X |
| 3,100,961 | 8/1963 | Bassett | 74/3.52 X |

*Primary Examiner*—Allan D. Herrmann

*Attorney, Agent, or Firm*—Joseph E. Rusz; Arsen Tashjian

[57] ABSTRACT

A mechanical, rotary, spring driven, snap action mechanism which has two snap positions, with an intervening intermittent delay.

5 Claims, 3 Drawing Figures

FIG. 1
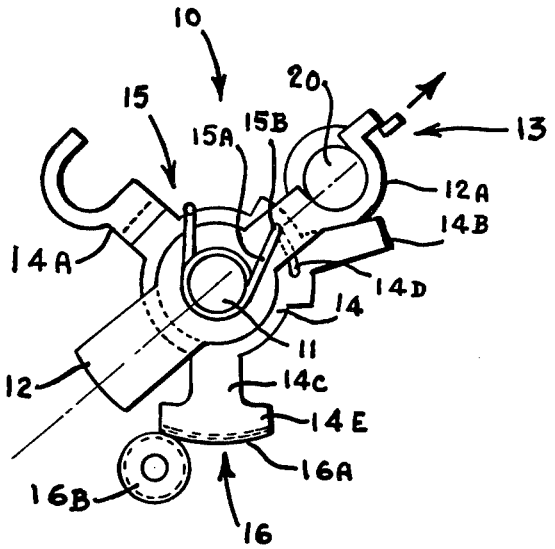
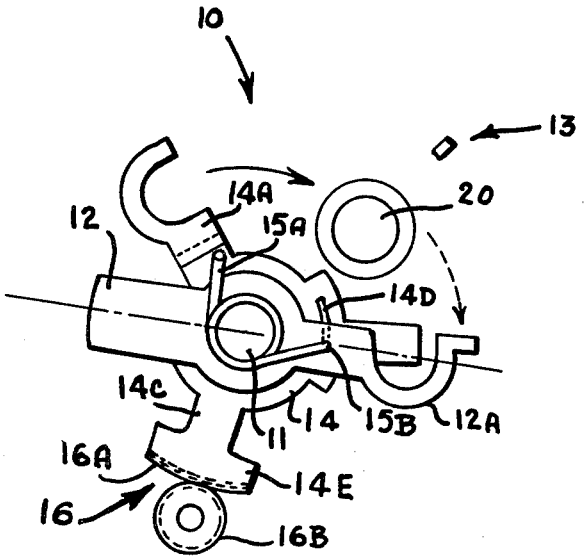
FIG. 2
FIG. 3
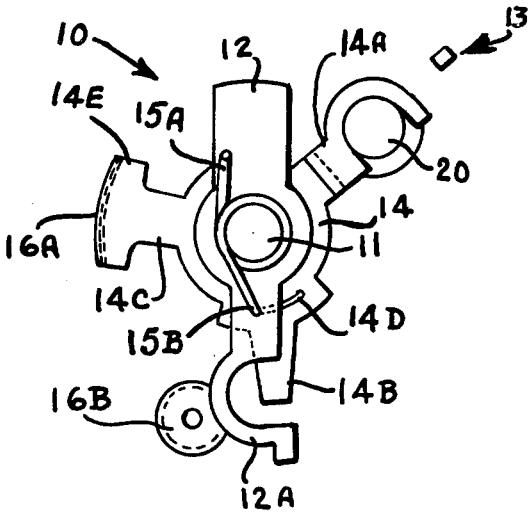

DOUBLE ACTING DELAY MECHANISM

STATEMENT OF GOVERNMENT INTEREST

The invention described herein may be manufactured and used by or for the Government for governmental purposes without the payment of any royalty thereon.

BACKGROUND OF THE INVENTION

This invention relates to a snap action mechanism and, more particularly, to such a mechanism that is mechanical, rotary, spring-driven and which has two snap positions, with an intermittent delay.

A need has arisen for a mechanical delay which has a double snap action. More specifically, the interfacing (i.e., driving) element of the escapement should, upon release, snap through an arc. Then, move slowly through another arc in the same direction to provide the desired delay time. Then, and finally, snap through a third arc also in the same direction, to its final position.

I have invented a mechanism which fulfills this need; and, thereby, I have significantly advanced the state-of-the-art.

SUMMARY OF THE INVENTION

The invention pertains to a double snap acting delay mechanism which satisfies the aforesaid need.

Accordingly, the principal object of this invention is to provide the aforesaid described double snap acting delay mechanism.

This object, as well as other related objects, of this invention will become readily apparent after a consideration of the description of the invention, together with reference to the Figures of the drawings, in which the same reference character refers to the same component and the like.

DESCRIPTION OF THE DRAWINGS

FIGS. 1–3, inclusive, are top plan views, in simplified pictorial and schematic form, of a preferred embodiment of my inventive mechanism, in a working environment, during the following sequential phases or conditions of operation: FIG. 1, initial position (i.e., engaged);

FIG. 2, intermediate (i.e., released; and,

FIG. 3 final position (i.e., re-engaged).

DESCRIPTION OF THE PREFERRED EMBODIMENT

As a preliminary matter, it is to be noted that in FIGS. 1–3, the preferred embodiment 10 of my inventive mechanism is shown in an adaptation where the mechanism serves as a safing and arming device timer gate to trap, then release, then retrap a safety pin 20. This adaptation or application is for illustrative purposes only, and is not intended as a limitation of my inventive mechanism.

Still with reference to FIGS. 1–3, inclusive, the preferred embodiment of my inventive double snap acting delay mechanism includes: a shaft 11; a first member 12 that is pivotally mounted on the shaft 11, and that has a first end 12A of a preselected configuration (i.e., in this instance, to complement the periphery of safety pin 20); a means, generally designated 13, for selectively restraining and releasing the first end 12A of the first member 12; a second member 14 that is adjacent to the first member 12, that is pivotally mounted on the shaft 11, and that has a first leg 14A which is complementary to the first end 12A of the first member 12, a second leg 14B, and a third leg 14C; means, generally designated 15, for biasing the first member 12 to the second member 14, with this biasing means 16 also interconnecting the first member 12 near its first end 12A and the second member 14 near its second leg 14B; and, means, generally designated 16, for selectively and arcuately (i.e., angularly) moving the third leg 14C of the second member 14.

The means 13 for selectively restraining and releasing the first end 12A of the first member 12 (and, of course, the first member 12) is disposed at the first end 12A of the first member 12, and is movable (as indicated by the directional arrow) from that position.

The means 15 for biasing the first member 12 to the second member 14 includes, preferably, a torsion spring 15A (i.e., a drive spring) that is attached to the first member 12. The spring 15A has a first end 15B which passes into, and extends through, the first member 12 near the first end 12A of that member 12. The first end 15B of the spring 15A also engages an arcuate slot 14D in the second member 14, near the second leg 14B of that member 14.

The means 16 for selectively and arcuately (i.e., angularly) moving the third leg 14C of the second member 14 includes: a gear segment (i.e., sector) 16A at the first end 14E of the third leg 14C of the second member 14; and, a rotatable pinion 16B that is complementary to, and mates with, the gear segment 16A.

It is to be noted that, as a matter of preference and not of limitation, the first leg 14A, the second leg 14B, and the third leg 14C of second member 14 are disposed in equal spaced-apart relationship.

MANNER OF OPERATION OF THE PREFERRED EMBODIMENT

The manner of operaation of the preferred embodiment 10 can be easily ascertained by any person of ordinary skill in the art from the foregoing description, coupled with reference to FIGS. 1–3, inclusive.

For others, it is sufficient to say in explanation that, when the first end 12A of the first member 12 is selectively released by moving restraint 13, the first member 12 is released and snaps arcuately (i.e., angularly) clockwise (as indicated by the phantom arrow, FIG. 2) until the first end 15B of the drive spring 15A reaches the end of slot 14D in second member 14. At this point, both the first member 12 and the second member 14 (including gear segment 16A) are driven (by drive spring 15A) arcuately clockwise. As soon as the gear segment 16A has rotated out of mesh with the pinion 16B, FIG. 3, the first and second members 12 and 14 snap to the terminal position.

As previously stated herein, an application of my invention is as a safing and arming device timer gate. The two "arms" (i.e., configurated first end 12A of first member 12, and complementarily configured first leg 14A of second member 14) trap, then release, then retrap a safety pin, such as 20, FIGS. 1–3, inclusive.

CONCLUSION

It is abundantly clear from all of the foregoing, and from the Figures of the drawings, that the stated desired principal object, as well as other related objects, of the invention have been achieved.

It is to be noted that, although there have been described and shown the fundamental and unique features of my invention as applied to a preferred embodiment adapted for a particular application, various other embodiments, variations, adaptations, substitutions, additions, omissions, and the like may occur to, and can be made by, those of ordinary skill in the art, without departing from the spirit of my example. For example, first member 12 and second member 14 preferably are made of metal, but may be made of what is colloquially referred to as "plastic" material.

What is claimed is:

1. A double snap acting delay mechanism, comprising:

a. a shaft;

b. a first member pivotally mounted on said shaft and having a first end with a preselected configuration;

c. means for selectively restraining and releasing said first member at said first end;

d. a second member adjacent to said first member and pivotally mounted on said shaft, wherein said second member has: a first leg configurated complementarily to said first end of said first member; a second leg; and, a third leg;

e. means for biasing said first member to said second member, wherein this said biasing means also interconnects said first member near said first end thereof and said second member near said second leg thereof;

f. and, means for selectively and arcuately moving said third leg of said second member.

2. A double snap acting delay mechanism, as set forth in claim 1, wherein said means for selectively restraining and releasing said first member at said first end is disposed at said first end and is movable therefrom.

3. A double snap acting delay mechanism, as set forth in claim 2, wherein said means for biasing said first member to said second member includes a torsion spring attached to said first member, with said spring having a first end which passes into, and extends through, said first member near said first end thereof and which engages an arcuate slot in said second member near said second leg thereof.

4. A double snap acting delay mechanism, as set forth in claim 3, wherein said third leg of said second member has a first end, and wherein said means for selectively and arcuately moving said third leg of said second member includes:

a. a gear segment at said first end of said third leg of said second member;

b. and, a rotatable pinion complementary to, and mating with, said gear segment.

5. A double snap acting delay mechanism, as set forth in claim 4, wherein said first, second, and third legs of said second member are disposed in equal spaced-apart relationship.

* * * * *